US006024609A

United States Patent [19]

Kooiman et al.

[11] Patent Number: 6,024,609

[45] Date of Patent: Feb. 15, 2000

[54] OUTER CONTACT SPRING

[75] Inventors: John A. Kooiman, Lockport; Frank A. Harwath, Downers Grove, both of Ill.

[73] Assignee: Andrew Corporation, Orland Park, Ill.

[21] Appl. No.: 08/963,015

[22] Filed: Nov. 3, 1997

[51] Int. Cl.[7] ..... H01R 17/04

[52] U.S. Cl. ..... 439/675; 439/578; 411/433

[58] Field of Search ..... 439/675, 578, 439/825; 411/366, 386, 436, 437, 433

[56] References Cited

U.S. PATENT DOCUMENTS

| | | | |
|---|---|---|---|
| 3,199,061 | 8/1965 | Johnson et al. . | |
| 3,281,756 | 10/1966 | O'Keefe et al. | 339/89 |
| 3,291,895 | 12/1966 | Van Dyke . | |
| 3,391,381 | 7/1968 | Livingston | 339/143 |
| 3,394,400 | 7/1968 | Lamons | 174/102 |
| 3,461,409 | 8/1969 | Miller | 333/98 |
| 3,601,776 | 8/1971 | Curl | 439/675 |
| 3,824,526 | 7/1974 | Glover | 339/94 R |
| 3,842,390 | 10/1974 | Glover et al. | 339/14 R |
| 4,046,451 | 9/1977 | Juds et al. | 339/177 R |
| 4,154,496 | 5/1979 | Gallagher | 399/89 R |
| 4,634,208 | 1/1987 | Hall et al. | 339/143 R |
| 4,781,622 | 11/1988 | Ratchford et al. | 439/585 |
| 4,800,351 | 1/1989 | Rampalli et al. | 333/237 |
| 4,869,690 | 9/1989 | Frear et al. | 439/675 |
| 4,910,998 | 3/1990 | Willis et al. | 73/40.5 R |
| 5,021,010 | 6/1991 | Wright | 439/578 |
| 5,063,659 | 11/1991 | Wright | 29/860 |
| 5,071,301 | 12/1991 | Engelhardt et al. | 411/389 |
| 5,074,809 | 12/1991 | Rousseau | 439/675 |
| 5,106,251 | 4/1992 | Steinbach | 411/433 |
| 5,110,308 | 5/1992 | Nishikawa et al. | 439/582 |
| 5,127,843 | 7/1992 | Henry et al. | 439/320 |
| 5,137,470 | 8/1992 | Doles | 439/578 |
| 5,154,636 | 10/1992 | Vaccaro et al. | 439/583 |
| 5,167,533 | 12/1992 | Rauwolf | 439/583 |
| 5,207,596 | 5/1993 | Tran | 439/585 |
| 5,217,391 | 6/1993 | Fisher, Jr. | 439/578 |
| 5,232,377 | 8/1993 | Leibfried, Jr. | 439/320 |
| 5,281,167 | 1/1994 | Le et al. | 439/578 |
| 5,334,051 | 8/1994 | Devine et al. | 439/583 |
| 5,354,217 | 10/1994 | Gabel et al. | 439/583 |
| 5,422,614 | 6/1995 | Rampalli et al. | 333/237 |
| 5,435,745 | 7/1995 | Booth | 439/584 |
| 5,486,123 | 1/1996 | Miyazaki | 439/825 |
| 5,492,446 | 2/1996 | Hawkins et al. | 411/424 |
| 5,561,900 | 10/1996 | Hosler, Sr. | 29/828 |
| 5,595,499 | 1/1997 | Zander et al. | 439/578 |

FOREIGN PATENT DOCUMENTS

| | | |
|---|---|---|
| 0 576 785 A2 | 3/1993 | European Pat. Off. . |
| 0 449 817 B1 | 5/1993 | European Pat. Off. . |
| 4309775 A1 | 9/1994 | Germany . |
| 2223 892A | 10/1988 | United Kingdom . |
| 2277207A | 3/1994 | United Kingdom . |

OTHER PUBLICATIONS

Drawing of TelegartnerConnector.

*Primary Examiner*—Paula Bradley
*Assistant Examiner*—Tho D. Ta
*Attorney, Agent, or Firm*—Arnold White & Durkee

[57] ABSTRACT

A connector assembly is provided for engagement with a mating connector and a coaxial device. The connector assembly includes a body member attachable to the coaxial device. The body member is also attachable to the mating connector. An outer contact spring is provided with an annular base for threadably connecting to the body member. The annular base has a plurality of spring fingers extending longitudinally away from the annular base, each one of the plurality of spring fingers includes a base end and a distal end. Each adjacent pair of the spring fingers define a longitudinal slit that is narrow enough to prevent inward flexure of the spring fingers beyond a point where the flexed spring finger contacts an adjacent spring finger.

19 Claims, 7 Drawing Sheets

OUTER CONTACT SPRING

FIELD OF THE INVENTION

The present invention relates generally to connector assemblies for coaxial cables. More particularly, it relates to an improved outer contact spring for use in various coaxial cable connector assemblies.

BACKGROUND OF THE INVENTION

Connector assemblies for coaxial cables have been used throughout the semi-flexible coaxial cable industry for a number of years. These connector assemblies allow each cable to be interconnected with other cables and/or electrical devices. These connector assemblies must make good electrical contact with each other and with their corresponding cables or devices in order to provide good signal transmission. Connector assemblies generally include a clamping member for connection to the coaxial cable and a body member for connection to the clamping member. The body member is configured to receive and connect to a mating connector. Connector assemblies also generally include a fitting having a mating portion, which is usually female, for connection to a corresponding male mating connector. In order to provide good mechanical stability and electrical contact between the connector assembly and the mating connector, the female mating portion of the connector assembly is configured to receive the male mating connector so that each is aligned with the other and both are mechanically and electrically connected to each other.

However, known connector fittings have the following disadvantages: being easily damaged from a misaligned mating connector, being difficult to engage with the mating connector, lacking sufficient localized contact pressure with the mating connector, having sharp edges that scrape conductive plating on the engaging surfaces of the mating connector and the fitting, being difficult to install and remove, having wide slots between the fingers of the mating portion that do not prevent excessive flexing of the fingers and being of a generally uniform thickness which decreases the maximum possible distal end deflection of the fingers.

Therefore, there is a need for easy to install outer contact springs for use in new and existing connector assemblies that do not suffer from the above mentioned deficiencies.

SUMMARY OF THE INVENTION

A connector assembly is provided for engagement with a mating connector and a coaxial device. The connector assembly includes a body member attachable to the coaxial device. The body member is also attachable to the mating connector. An outer contact spring is provided with an annular base for threadably connecting to the body member. The annular base has a plurality of spring fingers extending longitudinally away from the annular base, each one of the plurality of spring fingers includes a base end and a distal end. Each adjacent pair of the spring fingers define a longitudinal slit that is narrow enough to prevent inward flexure of the spring fingers beyond a point where the flexed spring finger contacts an adjacent spring finger.

It is an object of the present invention to provide a contact spring with a plurality of spring fingers defining narrow longitudinal slits therebetween that give the outer contact spring the ruggedness of a solid barrel design combined with the performance of a traditional spring finger design.

It is yet another object of the present invention to provide a contact spring with a plurality of spring fingers which each have rounded distal ends for preventing damage from a misaligned mating connector by allowing the misaligned mating connector to pivot around the rounded distal ends without damaging the spring fingers.

It is still another object of the present invention to provide a contact spring with a plurality of spring fingers which each have rounded distal ends for smooth sliding engagement of the outer contact spring and the male mating connector.

It is a further object of the present invention to provide a contact spring with a plurality of spring fingers which each have rounded distal ends for improving the Intermodulation Distortion ("IMD") performance by increasing the localized contact pressure on the mating connector and eliminating sharp edges that might scrape the conductive plating on the engaging surfaces of the mating connector and the spring fingers.

It is another object of the present invention to provide a contact spring with a plurality of narrow longitudinal slits that allow for flexure of the spring fingers while preventing excessive inward flexing of the spring fingers beyond a point where the flexed spring finger contacts an adjacent spring finger.

It is a further object of the present invention to provide a contact spring with a base having threaded portions separated by at least one flat section for accommodating a tool to facilitate installation and removal of the outer contact spring.

It is yet another object of the present invention to provide a contact spring with a plurality of spring fingers wherein each spring finger has a thickness and wherein the thickness is greater at the base end than the distal ends and decreases from the base end to the distal ends thereby allowing greater deflection at the distal ends while maintaining a high fatigue strength at the base end.

DESCRIPTION OF ILLUSTRATIVE EMBODIMENTS

Figure 1A:
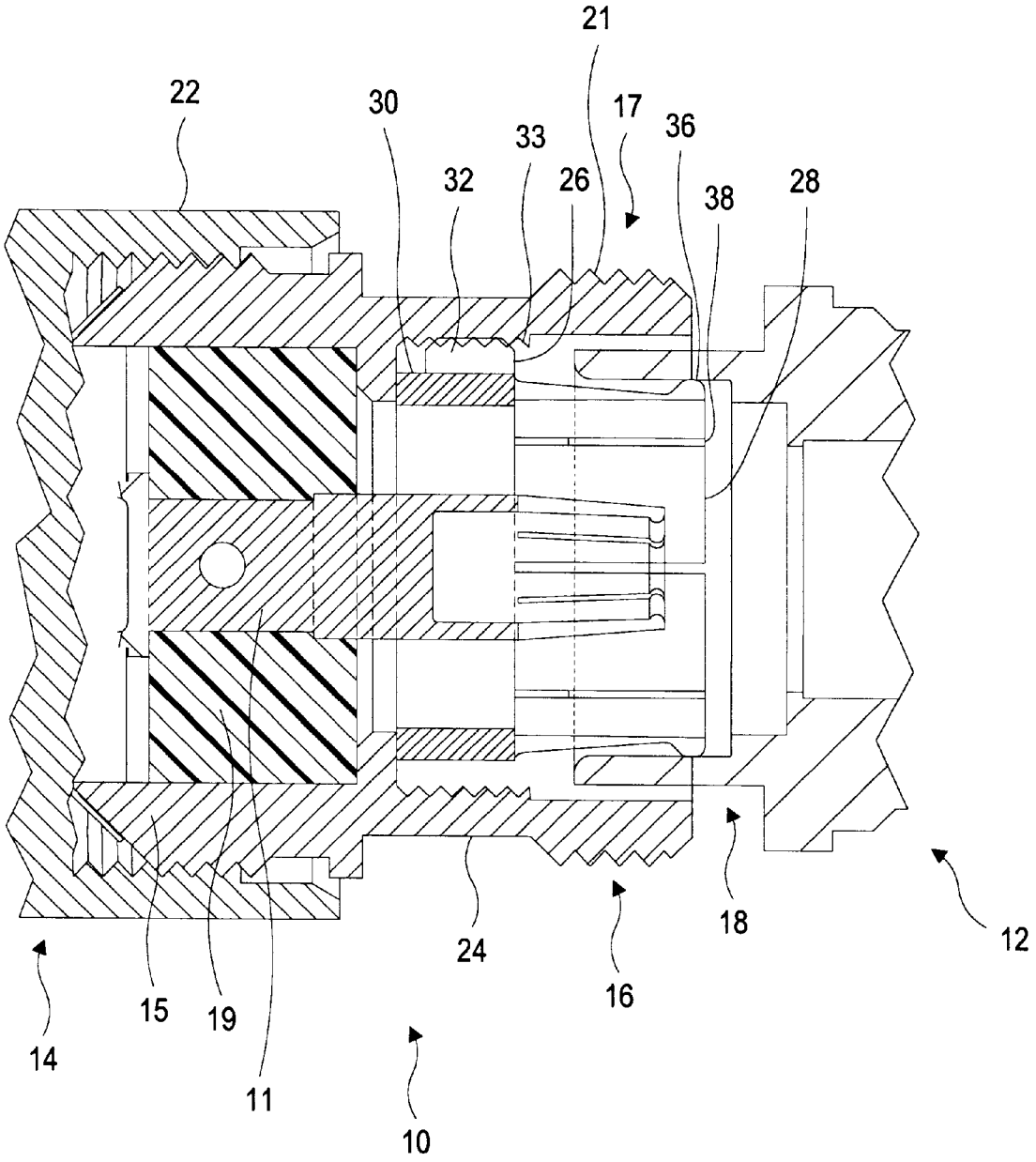
FIG. 1*a* is a cross-sectional view of a connector assembly, including a contact spring, and a mating connector where the mating connector is aligned with the connector assembly.
Figure 1B:
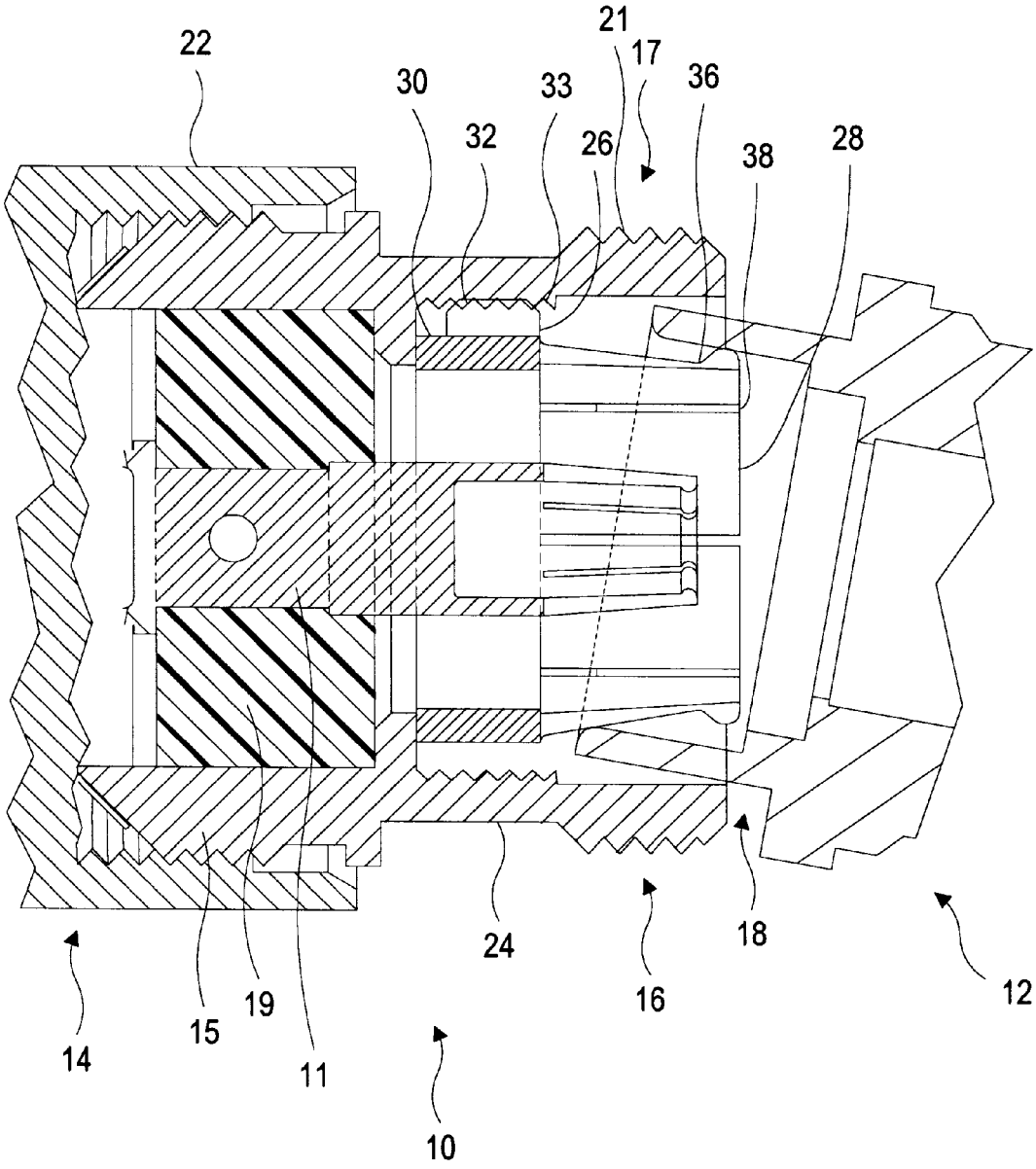
FIG. 1*b* is a cross-sectional view of a connector assembly, including a contact spring, and a mating connector where the mating connector is misaligned with the connector assembly.

Turning now to the drawings, the preferred embodiment of the present invention is shown in FIGS. 1–6. FIGS. 1*a* and 1*b* illustrate the connector assembly 10 which has a first end 14 for attaching to a coaxial cable (not shown). As is known in the art, the cable includes an outer conductor concentrically spaced from a hollow inner conductor by a foam dielectric. The connector assembly 10 comprises a clamping member 22 for attachment to the coaxial cable, a body member 24 having a first end 15 for threadably connecting to the clamping member 22 and a second end 17 for threadably connecting to a mating connector 12, an inner contact 11 for connection to the inner conductor of the coaxial cable and an insulator 19 for centering the inner contact 11 within the connector assembly 10 while electrically isolating the inner contact 11 from the rest of the connector assembly 10. The mating connector 12 includes a coupling nut (not shown) for threadably connecting the mating connector 12 to the threading 21 on the second end 17 of the body member 24. The mating connector 12 also includes a retaining ring (not shown) for securing the coupling nut to the mating connector 12. The coupling nut is a conventional fitting and is secured to the mating connector 12 by the retaining ring which holds the nut captive on the mating connector 12 while permitting free rotation of the nut on the mating connector 12.

To prepare the coaxial cable for attachment to the connector assembly 10, the end of the cable is cut perpendicular to the axis of the cable. This exposes the clean and somewhat flared internal surface of the outer conductor. Any burrs or rough edges on the cut ends of the metal conductors are preferably removed to avoid interference with the connector. The outer surface of the outer conductor is normally covered with a plastic jacket which is trimmed away from the end of the outer conductor along a length sufficient to accommodate the connector assembly 10.

The connector assembly 10 is then structurally and electrically connected to the prepared end of the cable. To effectuate a structural and electrical connection between the inner contact 11 of the connector assembly 10 and the inner conductor of the cable, the inner contact 11 may be soldered, threaded or connected via spring fingers to the inner conductor. To effectuate a structural and electrical connection between the connector assembly 10 and the outer conductor of the cable, the cable is captured and clamped between the clamping member 22 and the body member 24.

An electrical and mechanical connection is made between the connector assembly 10 and the mating connector 12. The second female end 16 of the connector assembly 10 electrically and mechanically connects to a cylindrical end portion 18 of the mating connector 12. The mating connector 12 has a second end (not shown) for attachment to another coaxial cable, an electrical device, etc.

Figure 4:
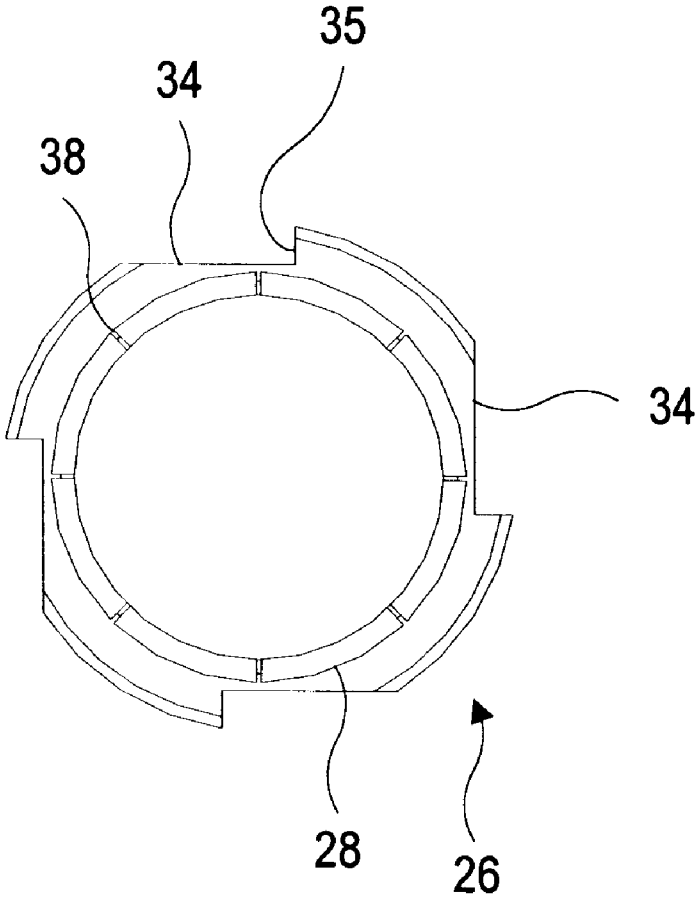
FIG. 4 is an end elevational view from the top end of the contact spring of FIG. 2.

An outer contact spring 26 includes an annular base 30 having threaded portions 32 for threadably connecting to the corresponding internal threads 33 of the body member 24. To facilitate installation and removal of the outer contact spring 26 from the body member 24, the threaded portions 32 are separated by flat sections 34 (illustrated in FIGS. 3 and 4) that accommodate a tool. In order to provide four flat sections 34, FIG. 4 illustrates that the flat sections 34 are spaced 90 degrees away from each other, the angular measurement being taken with respect to lip 35 of each of the flat sections 34.

To provide an electrical connection between the outer conductor of the body member 24 and the mating connector 12, the outer contact spring 26 is provided with spring fingers 28 for electrically connecting to, and frictionally engaging with, the inside surface of the hollow cylindrical end portion 18 of the mating connector 12. To allow for universal compatibility, the outer contact spring 26 is configured to be compatible with all 7/16 inch DIN interface standard connectors.

The electrical and frictional connection between the outer contact spring 26 and the cylindrical end portion 18 of the mating connector 12 is provided by the plurality of spring fingers 28 which extend away from the annular base 30. In order to provide a smooth sliding engagement between the spring fingers 28 and the mating connector 12, the spring fingers 28 are rounded on their free distal ends 36. The smooth sliding engagement provided by the rounded ends of the spring fingers 28 helps to prevent damage from a misaligned mating connector 12 by allowing the misaligned mating connector 12 to pivot around the rounded ends 36 without damaging the spring fingers 28. The rounded spring fingers 28 also improve Intermodulation Distortion ("IMD") performance by increasing the localized contact pressure between the spring fingers 28 and the cylindrical end portion 18. The rounded spring fingers 28 also improve the IMD performance by eliminating any sharp edges that might scrape conductive plating on the engaging surfaces of the mating connector 12 and the spring fingers 28.

In order to protect the spring fingers 28 from damage caused by excessive flexing of a spring finger when the mating connector 12 is misaligned with the outer contact spring 26 (see FIG. 1*b*), the spring fingers 28 have only narrow longitudinal slits 38 between adjacent fingers 28. The narrow slits 38 allow for flexure of the spring fingers 28 while preventing excessive flexure of any one spring finger, such as spring finger 28*a* (see FIG. 3), by preventing inward flexure of the spring finger 28*a* beyond a point where the spring finger 28*a* contacts the adjacent spring fingers 28*b* and 28*c*. Thus, the narrow longitudinal slits 38 allow the adjacent spring fingers 28*b* and 28*c* to limit the flexing movement of the finger 28*a* and protect it from damage caused by excessive inward flexure. Preventing excessive flexing of the spring fingers 28 gives the outer contact spring 26 the ruggedness of a solid barrel design combined with the performance of a traditional spring finger design.

Figure 2:
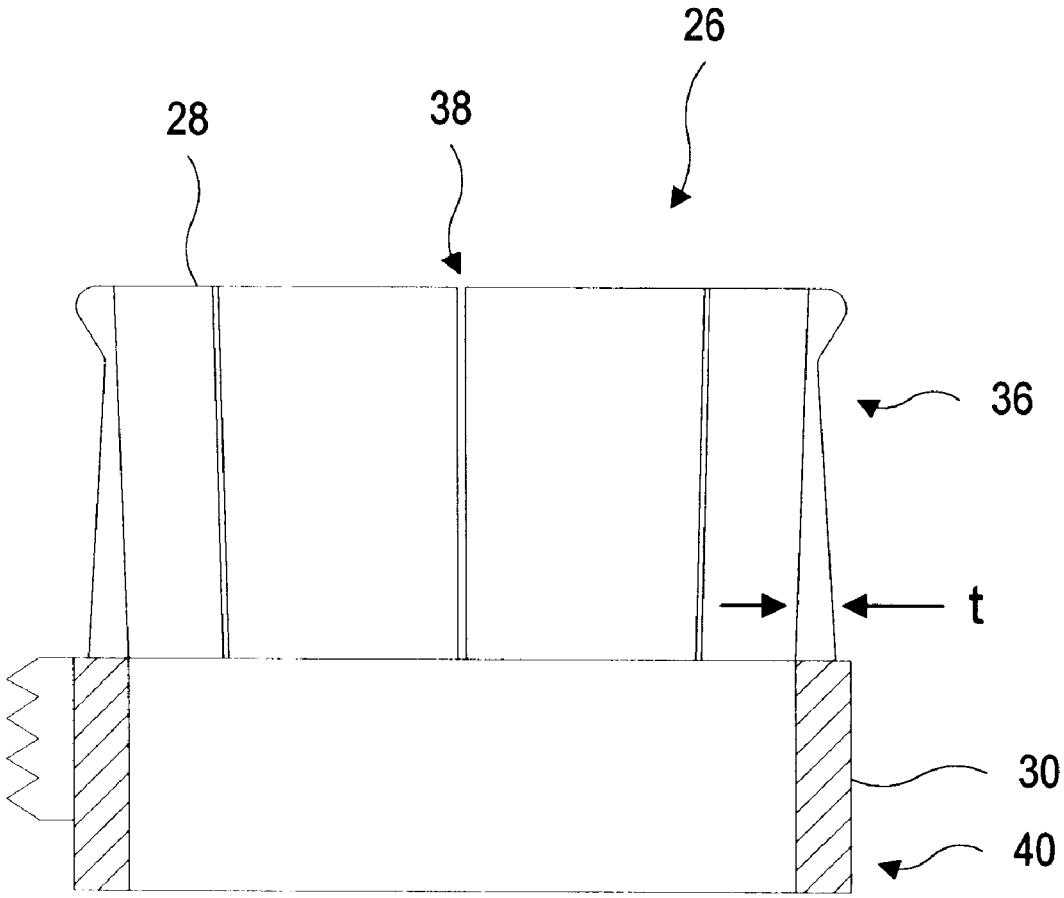
FIG. 2 is an enlarged cross-sectional view of the contact spring included in the connector assembly of FIG. 1.
Figure 3:
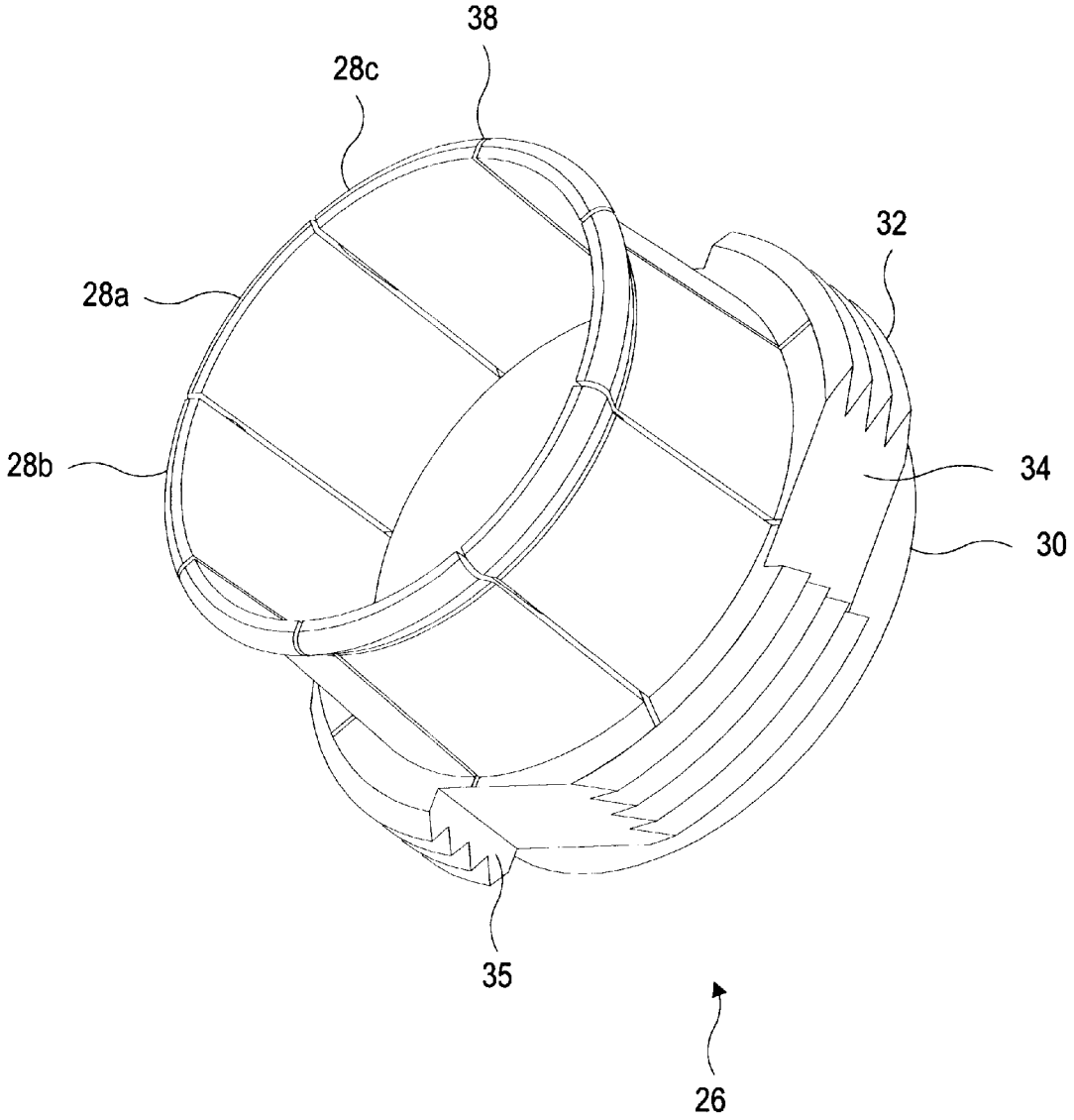
FIG. 3 is a perspective view of the contact spring of FIG. 2.

In order to provide a uniform stress distribution along the length of the spring fingers 28 while making efficient use of material, FIG. 2 further illustrate that the spring fingers 28 have a thickness t, that diminishes from the base end 40 to the rounded distal ends 36. Thus, to provide the greatest support for the spring fingers 28 at their most stressed points, the thickness t is greatest at the base end 40. The thickness t then decreases from the base end 40 to the distal ends 36 where the spring fingers 28 have less stress. The tapered spring fingers 28 allow for greater deflections at the distal ends 36 while maintaining a high fatigue strength at the base end 40.

Although the above detailed description is focused on one particular connector assembly, it is to be recognized that the outer contact spring 26 of the present invention can be used in various connector assemblies. For example, the outer contact spring 26 may be connected to a one-piece connector assembly instead of the two-piece connector assembly 10 described above. Because the various other connector assemblies in which the present invention may be used are known in the art, only the one exemplary connector assembly 10 is described in detail.

Figure 5:
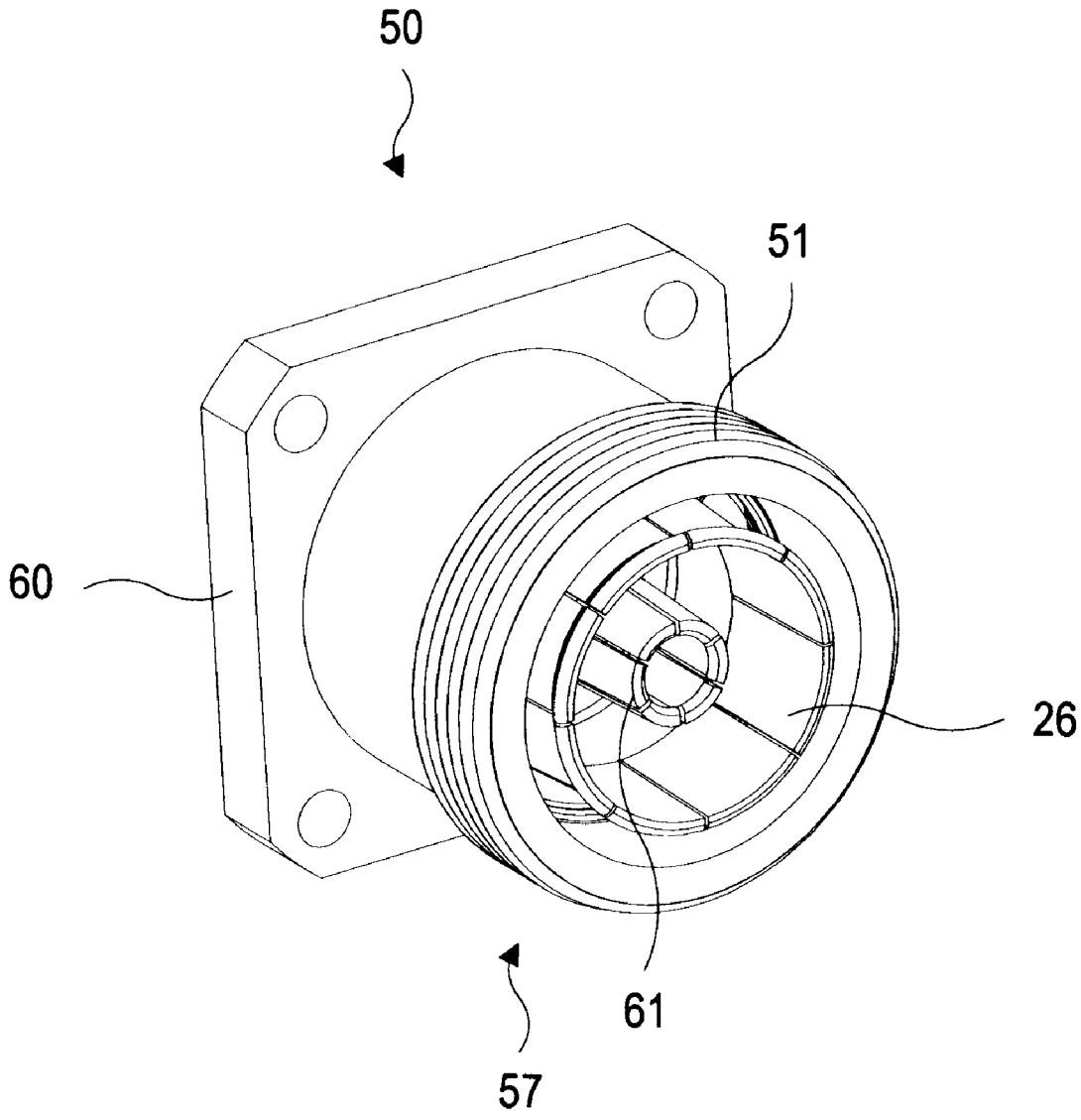
FIG. 5 is a perspective view of an alternative connector assembly, including the contact spring of FIG. 2.
Figure 6:
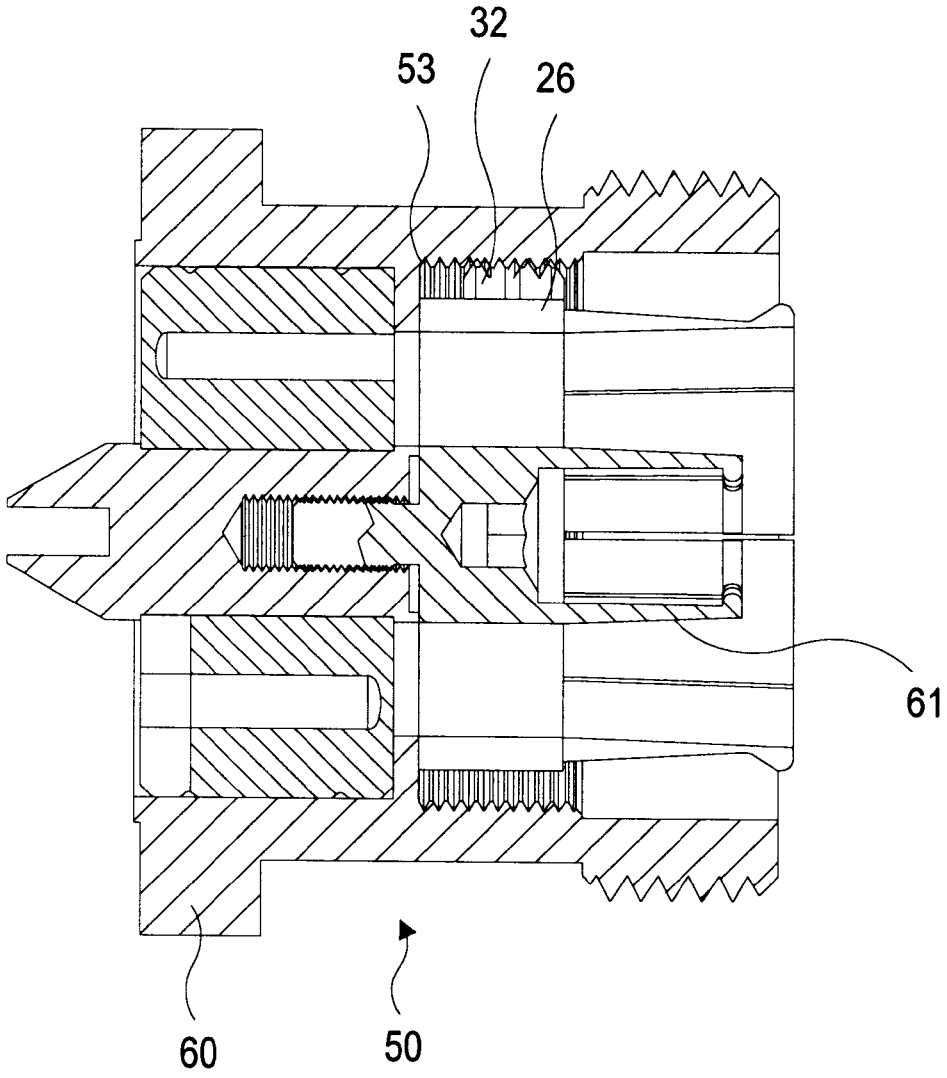
FIG. 6 is a cross-sectional view of the connector assembly of FIG. 5, including the contact spring of FIG. 2.

FIGS. 5 and 6 illustrate another embodiment of the present invention where an alternative connector assembly 50 includes the contact spring 26 of the present invention. FIG. 5 shows the one piece connector assembly 50 which includes threading 51 on the distal end 57 of the connector assembly 50. Similar to the above described connector assembly 10, the connector assembly 50 mechanically connects with the mating connector 12 via a conductive coupling nut (not shown) that threadably connects the mating connector 12 to the threading 51 on the distal end 57 of the connector assembly 50. The proximal end of the connector assembly 50 has a flange 60 that connects with a coaxial device such as an antenna, a filter, a coaxial adapter, test equipment, etc.

FIG. 6 shows the connector assembly 50 mechanically connected to the outer contact spring 26. The threaded portions 32 of the contact spring 26 threadably connect to the corresponding internal threads 53 of the connector assembly 50. FIGS. 5 and 6 illustrate an inner contact 61 which provides an electrical connection with the inner conductor of the coaxial cable.

In another embodiment of the present invention, the outer contact spring 26 includes a smooth or knurled non-threaded base that is configured to be press fitted, soldered or welded into a connector assembly such as connector assembly 10 or 50.

It is to be understood that while the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A connector assembly for engagement with a mating connector and a coaxial cable having an end portion, said connector assembly comprising:

a clamping member having a first end and a second end, said first end of said clamping member being attachable to said end portion of said coaxial cable;

a body member having a first end and a second end, said first end being attachable to said second end of said clamping member; and an outer contact spring having an annular base threaded for connection to said second end of said body member and a plurality of spring fingers extending longitudinally away from said annular base, each adjacent pair of said spring fingers defining a longitudinal slit that is narrow enough to prevent inward flexure of any one of said spring fingers beyond a point where the flexed spring finger contacts the adjacent spring fingers.

2. The connector assembly of claim 1 wherein said distal end of each of said spring fingers is rounded.

3. The connector assembly of claim 1 wherein said annular base includes threaded portions separated by a plurality of flat sections for facilitating installation and removal of said outer contact spring.

4. The connector assembly of claim 1 wherein each of said spring fingers has a base end and a distal end, and the thickness of each finger varies from said base end to said distal end.

5. The connector assembly of claim 4 wherein said thickness of said spring fingers is greater at said base end than said distal end and wherein said thickness decreases from said base end to said distal end.

6. A connector assembly for engagement with a mating connector and a coaxial device having an end portion, said connector assembly comprising:

a body member having a proximal end and a distal end, said proximal end being attachable to said coaxial device, said distal end being attachable to the mating connector; and an outer contact spring having an annular base threaded for connection to said body member and a plurality of spring fingers extending longitudinally away from said annular base, each adjacent pair of said spring fingers defining a longitudinal slit that is narrow enough to prevent inward flexure of any one of said spring fingers beyond a point where the flexed spring finger contacts the adjacent spring fingers.

7. The connector assembly of claim 6 wherein said distal end of each of said spring fingers is rounded.

8. The connector assembly of claim 6 wherein said annular base includes threaded portions separated by a plurality of flat sections for facilitating installation and removal of said outer contact spring.

9. The connector assembly of claim 6 wherein each of said spring fingers has a base end and a distal end, and the thickness of each finger varies from said base end to said distal end.

10. The connector assembly of claim 9 wherein said thickness of said spring fingers is greater at said base end than said distal end and wherein said thickness decreases from said base end to said distal end.

11. A connector assembly for engagement with a mating connector and a coaxial cable having an end portion, said connector assembly comprising:

a clamping member having a first end and a second end, said first end of said clamping member being attachable to said end portion of said coaxial cable;

a body member having a first end and a second end, said first end being attachable to said second end of said clamping member;

an outer contact spring having an annular base, said annular base being threaded for connection to said second end of said body member; said annular base having a plurality of spring fingers extending longitudinally away from said annular base, each one of said spring fingers having a base end and a distal end, and the thickness of each finger decreases from said base end to said distal end.

12. The connector assembly of claim 11 wherein said thickness of said spring fingers is greater at said base end than said distal end and wherein said thickness decreases from said base end to said distal end.

13. The connector assembly of claim 11 wherein said distal end of each one of said plurality of spring fingers is rounded.

14. The connector assembly of claim 11 wherein said annular base includes threaded portions separated by at least one flat section for facilitating installation and removal of said outer contact spring.

15. The connector assembly of claim 11 wherein each adjacent pair of said spring fingers define a longitudinal slit that is narrow enough to prevent inward flexure of said spring fingers beyond a point where the flexed spring finger contacts an adjacent spring finger.

16. An apparatus for interconnecting a connector assembly with a mating connector, said apparatus comprising:

an outer contact spring adapted to be attached to said connector assembly for electrically and mechanically connecting said connector assembly with said mating connector, said outer contact spring including finger means for engaging said mating connector when said finger means is deflected, said finger means having a plurality of arced segments, each adjacent pair of said arced segments defining a longitudinal slit that is narrow enough to prevent inward flexure of any one of said arced segments beyond a point where the flexed arced segment contacts the adjacent arced segments.

17. The apparatus of claim 16 wherein said arced segments each have a distal end, a base end and a thickness, wherein said thickness of each of said arced segments is greater at said base end than said distal end and wherein said thickness decreases from said base end to said distal end.

18. A method for interconnecting a connector assembly with a mating connector, said connector assembly including an outer contact spring having a plurality of spring fingers, said method comprising the steps of:

engaging said outer contact spring with said mating connector;

biasing said outer contact spring against said mating connector, where such biasing is accomplished by flexing said plurality of spring fingers inwardly so that an outer side of said spring fingers press against an opposed surface of said mating connector; and preventing inward flexure of any one of said spring fingers beyond a point where the flexed spring finger contacts the adjacent spring fingers.

19. The method of claim 18 wherein said outer contact spring has a distal end, a base end and a thickness, wherein said thickness of each of said arced segments is greater at said base end than said distal end and wherein said thickness decreases from said base end to said distal end.

* * * * *